United States Patent [19]

Green

[11] 4,375,205

[45] Mar. 1, 1983

[54] GLOW PLUG CONTROL CIRCUIT

[75] Inventor: Samuel J. Green, Temperance, Mich.

[73] Assignee: Champion Spark Plug Company, Toledo, Ohio

[21] Appl. No.: 165,730

[22] Filed: Jul. 3, 1980

[51] Int. Cl.[3] ..... F02N 17/00

[52] U.S. Cl. ..... 123/179 H; 123/145 A; 219/492; 219/497

[58] Field of Search ..... 123/179 H, 179 B, 179 BG, 123/145 A; 219/486, 492, 497, 202; 361/264

[56] References Cited

U.S. PATENT DOCUMENTS

| | | | |
|---|---|---|---|
| 1,662,031 | 3/1928 | McCormick | 219/492 |
| 1,848,966 | 3/1932 | Nero | 219/486 |
| 4,160,153 | 7/1979 | Melander | 219/492 |
| 4,196,712 | 4/1980 | Kawamuna et al. | 123/179 GB |
| 4,258,678 | 3/1981 | Abe | 219/497 |
| 4,285,307 | 8/1981 | Steinke | 123/145 A |

FOREIGN PATENT DOCUMENTS

| | | | |
|---|---|---|---|
| 2906731 | 9/1979 | Fed. Rep. of Germany | 123/145 A |
| 2031063 | 4/1980 | United Kingdom | 123/145 A |

*Primary Examiner*—P. S. Lall

*Attorney, Agent, or Firm*—John C. Purdue; Oliver E. Todd, Jr.

[57] ABSTRACT

Apparatus for applying power to at least two heater filaments of two glow plugs in a diesel engine, or to a heater of one glow plug and a ballast load having substantially the same maximum rated voltage as the filament, is disclosed. The power source has a supply voltage greater than the maximum rated voltage of the filament and sufficiently high to cause an overheating temperature capable of burning out the filament under continuous operation. A switch is operable in a first position to prevent the application of the supply voltage to the apparatus, operable in a second position to apply the supply voltage to the apparatus, and operable in a third position to maintain the condition of the second position and to apply the supply voltage to the apparatus and to a starter for the engine. The apparatus comprises means for applying the full supply voltage to each of the filaments by turning the switch from the first to the second position, and means operable, after a preheat time period which varies as an inverse function of available supply voltage and equals the time required to raise a filament from ambient temperature to a higher operating temperature sufficient for diesel engine starting, to reduce the voltage applied to the filaments by the first-named means and to maintain the operating temperature thereof for a prestart time period. The apparatus also includes means operable, after turning the switch from the second to the third position, to continue application of the reduced voltage to the filaments for an afterglow time period predetermined by the amount of time required for smooth engine idling and to minimize engine noise and white smoke emission.

3 Claims, 4 Drawing Figures

IGNITION PREHEAT
IGNITION START
PREHEAT PERIOD
PRESTART PERIOD
AFTERGLOW PERIOD
ON
OFF
ON
OFF
0
7
TIME
GLOW PLUG FILAMENTS
VOLTAGE
LAMP

FILAMENT OVERHEAT TEMPERATURE
FILAMENT OPERATING TEMPERATURE
a
b
0
7
TIME
TEMPERATURE

GLOW PLUG CONTROL CIRCUIT

BACKGROUND OF THE INVENTION

This invention relates to apparatus for applying power to at least two heater filaments of two glow plugs each projecting into a combustion chamber in a diesel engine, or to a heater filament of one glow plug and a ballast load having substantially the same maximum rated voltage as the filament. The glow plugs are heated by applying a source of power to the filament contained therein. The heated glow plug facilitates diesel engine starting by raising the temperature of air in the combustion chamber from ambient temperature to an operating temperature sufficiently high to start the engine. Therefore, an operator of the engine must wait a relatively substantial period of time before the glow plugs in the engine have been sufficiently heated to facilitate diesel engine starting.

The voltage source for the filaments can be, for example, a conventional vehicle battery which is also used to energize a starter for the engine. A decreasing battery voltage lengthens the period of time the operator must wait before the glow plugs have been sufficiently heated. One method of controlling filament temperature is to employ direct temperature feedback from the filaments. However, such a method requires more complex and expensive electronic components as well as a direct connection to the filaments during engine operation. Another problem involves de-energizing the filaments within some time period after the engine has started to prevent overheating and subsequent burnout.

BRIEF DESCRIPTION OF THE INVENTION

The instant invention is based upon the discovery of apparatus for applying power to at least two heater filament of two glow plugs in a diesel engine, or to a heater filament of one glow plug and a ballast load having substantially the same maximum rated voltage as the filament. The power source has a supply voltage greater than the maximum rated voltage of the individual filaments and sufficiently high to cause an overheating temperature capable of burning out the filaments under continuous operation. The apparatus comprises means for applying the full supply voltage to each of the filaments. Therefore, according to the instant invention, the operator of the engine waits a substantially shorter preheat period of time before the glow plugs in the engine have been sufficiently heated to facilitate diesel engine starting. The apparatus also includes means operable after the preheat time period to reduce the voltage applied to the filaments when the glow plugs reach a desired operating temperature and means operable to maintain that temperature for a prestart time period. The apparatus compensates for a decreasing supply voltage by varying the preheat time period as an inverse function of the available supply voltage. The apparatus also includes means operable to continue application of the reduced voltage to the filaments for a predetermined afterglow time period commencing after the engine has started. All the above-mentioned functions are predetermined, for example, by means of digital circuitry. Consequently, direct temperature feedback from the filaments is not employed and direct connections between the apparatus and the filaments are not required after the engine has been operating for a short period of time.

OBJECTS OF THE INVENTION

It is an object of the invention to provide apparatus for applying power to at least two heater filaments of two glow plugs in a diesel engine, or to a heater filament of one glow plug and a ballast load having substantially the same maximum rated voltage as the filament.

It is a further object of the invention to provide apparatus for applying power to at least two heater filaments of two glow plugs in a diesel engine, or to a heater filament of one glow plug and a ballast load having substantially the same maximum rated voltage as the filament, that minimizes the amount of time required to heat the glow plug(s) to an operating temperature sufficiently high to start the engine.

DETAILED DESCRIPTION OF THE INVENTION

Figure 1:
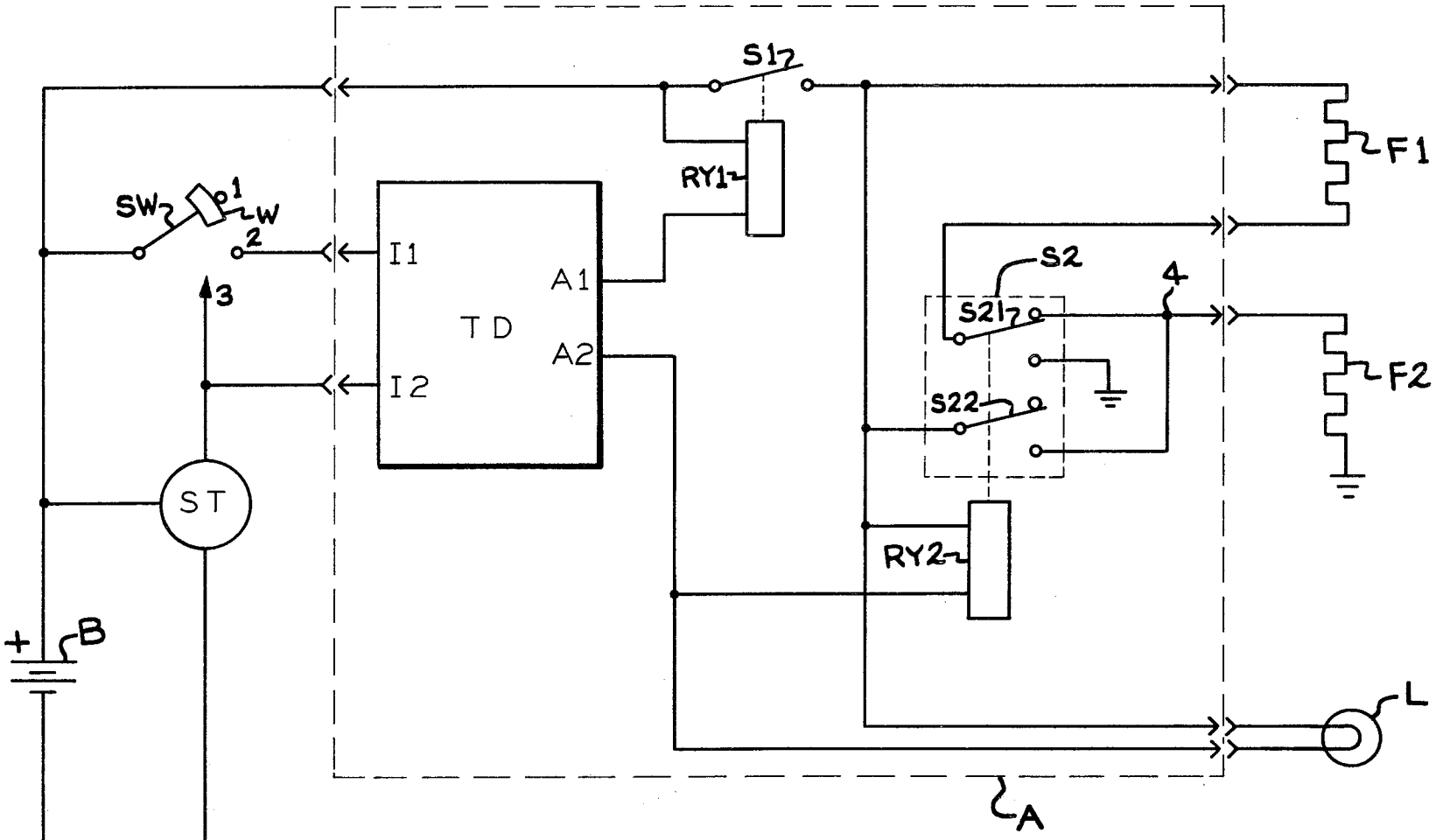
FIG. 1 is a schematic circuit diagram of apparatus for applying power to two heater filaments of two glow plugs in a diesel engine.

Referring now in more detail to FIG. 1, apparatus for applying power to first and second heater filaments F1 and F2 of two glow plugs in a diesel engine comprises the arrangement of electronic components shown within a dashed line A. A power source B is a conventional vehicle battery, for example, of twelve volts. A power relay RY1 when energized closes a normally-open power switch S1. A control relay RY2 when energized activates a 2-pole transfer switch S2 comprising first and second transfer switches S21 and S22 having a common output terminal 4 therebetween. The apparatus also comprises a time delay circuit TD having start and reset inputs I1 and I2 and power and control outputs A1 and A2 which energize the power and control relays RY1 and RY2 respectively. The control output A2 also energizes a lamp L.

The positive terminal of the battery B is connected in series with the open power switch S1, the first filament F1, the first transfer switch S21 through the common terminal 4 thereof and the second filament F2. The battery B and the open power switch S1 are also connected to the second transfer switch S22. The positive terminal of the battery B is also connected to a starter ST for the diesel engine and a movable wiper contact W of an ignition switch SW which is accessible to an operator of the engine. The movable wiper contact W, in an OFF position 1, prevents application of the battery voltage to the apparatus, in a PREHEAT position 2, applies the battery voltage to the start input I1 of the time delay circuit TD, and in a START position 3, maintains the condition of PREHEAT position 2 and applies the battery voltage to the reset input I2 of the time delay circuit TD and the starter ST for the engine. The ignition switch SW has means for automatically returning the movable wiper W from the START position 3 to the PREHEAT position 2 after the switch SW is released by the operator.

When the movable wiper contact W of the ignition switch SW is turned from the OFF position 1 to the PREHEAT position 2, a current from the battery B flows to the start input I1 of the time delay circuit TD. The power output A1 of the time delay circuit energizes the power relay RY1 to close the open power switch S1, and the control output A2 energizes the lamp L and the control relay RY2. Energizing the control relay RY2 activates the first transfer switch S21 causing the series connection from the battery B, through the power switch S1 and the first filament F1 to change from the common terminal 4 and the second filament F2 to ground. The control relay RY2 simultaneously activates the second transfer switch S22 enabling the battery B to energize the second filament F2 through the power switch A1 and the common terminal 4. Hence, when the first and second filaments F1 and F2 are switched from a de-energized series combination to an energized parallel combination with the battery B, the lamp L is energized (See FIG. 2, time zero) to apprise the operator of the condition.

Figure 3:
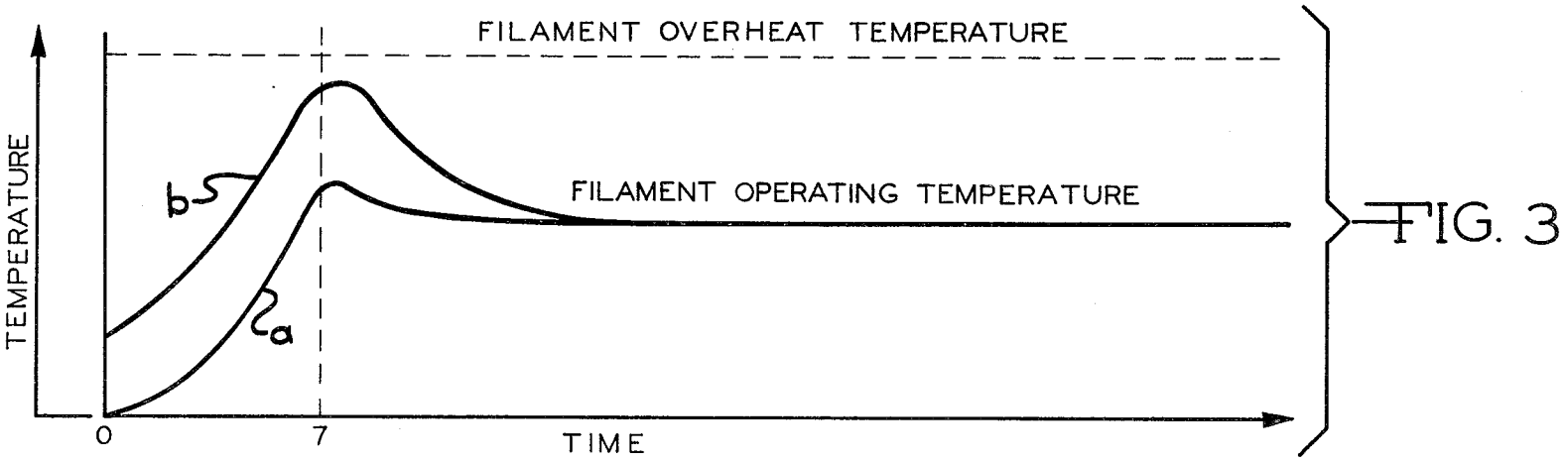
FIG. 3 is a graph showing the time-varying temperature of the glow plug filaments corresponding to the graphs of FIG. 2.

While the filaments are rated at a maximum voltage of one half the voltage of the power source, for example, six volts, the parallel combination thereof causes the full voltage of the battery B, for example, twelve volts, to be applied to each. This causes a rapid increase in filament temperature to heat the glow plugs of the diesel engine quickly, the object being to reduce the amount of time that the operator must wait before starting the engine. However, because the filaments F1 and F2 will eventually overheat and burn out at a specific overheat temperature (See FIG. 3, curve a), the applied voltage is reduced after a period of time within which the temperature of the filaments F1 and F2 rises from ambient temperature to a higher temperature sufficient for diesel engine starting but still below the specific overheat temperature.

This preheat time period, the amount of time that the operator must wait before starting the engine as indicated by the lamp, is approximately seven seconds. To reduce the applied voltage after this preheating, the control output A2 of the time delay circuit TD de-energizes both the control relay RY2 and the lamp L, while the power relay RY1 remains energized. When the control relay RY2 is de-energized, the first transfer switch S21 is deactivated causing the series connection from the battery B through the power switch S1 and the first filament F1 to change from ground back to the common terminal 4 and the second filament F2. The control relay RY2 simultaneously deactivates the second transfer switch S22 disabling the battery B from energizing the second filament F2 through the power switch S1 and the common terminal 4. Hence, when the filaments F1 and F2 are switched from the energized parallel combination back to an energized series combination, the "wait" lamp L is de-energized (See FIG. 2, time seven) to apprise the operator that the glow plugs have been sufficiently heated to start the engine. Because the series arrangement reduced the voltage applied to each of the filaments F1 and F2 to the maximum rated voltage thereof, the temperature of the filaments F1 and F2 decreases, after the preheat period, to an operating temperature below the overheat temperature (See FIG. 3, curve a, time seven).

Figure 2:
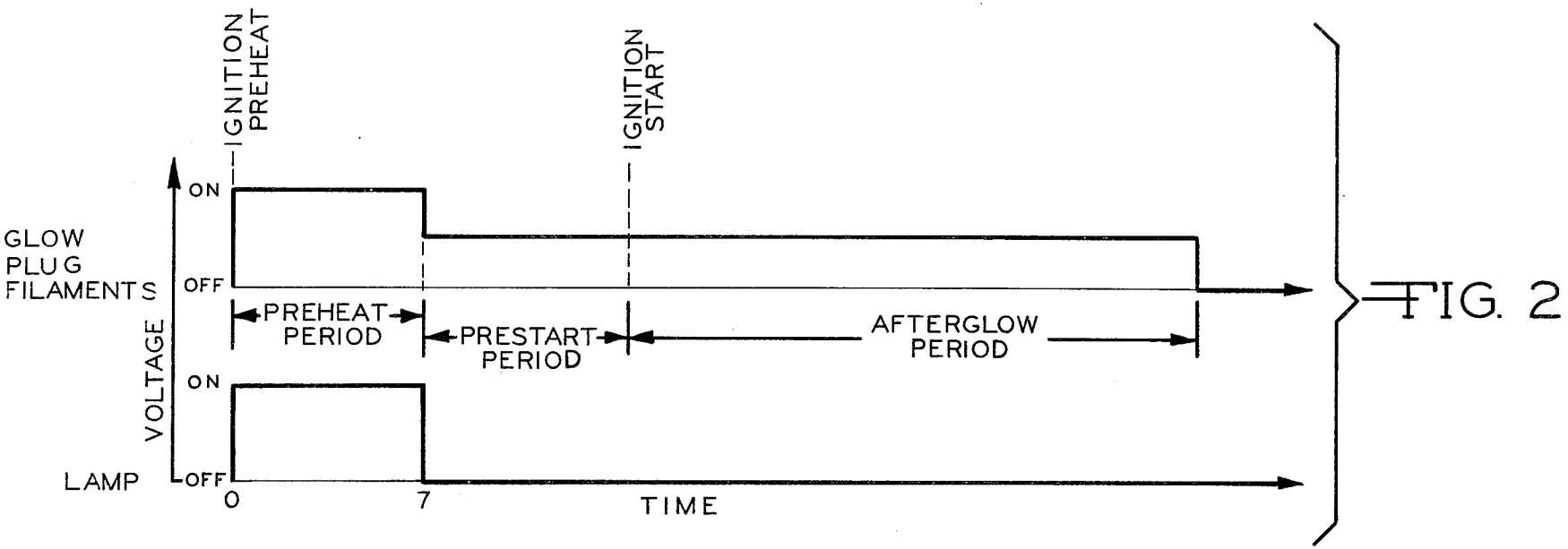
FIG. 2 is a graph showing the time-varying signals being applied to glow plug filaments and a lamp.

The power relay RY1 remains energized to maintain the operating temperature of the filaments F1 and F2 for a period of time of sufficient duration for the operator to start the engine. This prestart period is set at approximately thirty seconds by the power output A1 of the time delay circuit TD (FIG. 2). Whenever the operator engages the starter ST (FIG. 1) by turning the movable wiper contact W of the ignition switch SW from the PREHEAT position 2 to the START position 3, current flows to the starter ST. If the Starter ST is energized during the prestart period, current also flows to the reset input I2 of the time delay circuit TD. The signal to the reset input I2 of the time delay circuit TD prevents the power output A1 thereof from de-energizing the power relay RY1 for an additional thirty second time period (FIG. 2). During this afterglow time period, the glow plugs continue to be heated while the engine is operating. The after glow time period is predetermined to be the amount of time required for smooth engine idling and to minimize engine noise and the white smoke emission. After this period has expired, the power output A1 of the time delay circuit TD (FIG. 1) de-energizes the power relay RY1. This deactivates the power switch S1 to return it to its normally-open state which de-energizes the filaments F1 and F2.

If the engine is not started before the prestart period expires, the power output A1 of the time delay circuit TD de-energizes the power relay RY which causes the temperature of the filaments F1 and F2 to decrease from the operating level. However, the glow plugs may have generated sufficient heat for the engine to start even after the prestart period has expired. If the engine does not start, the operator must turn the ignition switch SW back from the PREHEAT position 2 to the OFF position 1 and then recycle the filaments F1 and F2 through the preheat period. When the operator attempts this sequence, the filaments F1 and F2 will probably be at a temperature higher than the initial ambient temperature. To prevent them from being overheated by reheating for a second full preheat period (See FIG. 3 curve b), the time delay circuit TD (FIG. 1) prevents the power and control relays of RY1 and RY2 from energizing for a period of one to three minutes after the operator returns the movable wiper contact W of the ignition switch SW to the OFF position 1. This delay allows the filaments F1 and F2 to cool to a temperature sufficiently near ambient to prevent the overheat and burnout at the specific overheat temperature in case the operator attempts to return the wiper contact W to the PREHEAT position 2 too soon.

Figure 4:
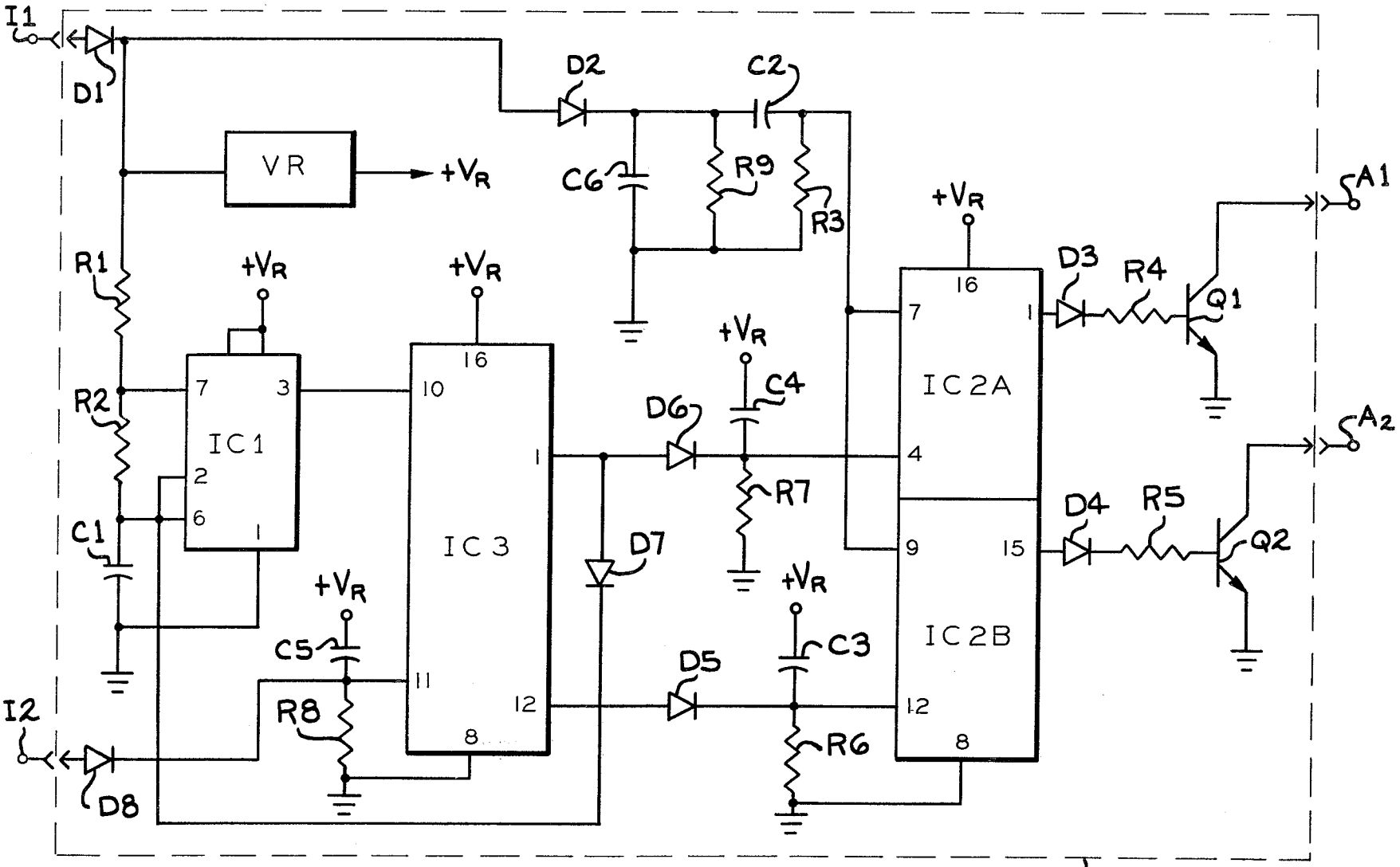
FIG. 4 is a schematic circuit diagram of a time delay circuit for use in the apparatus of FIG. 1.

The time delay circuit TD can be any of an analog or digital type capable of effecting the functions described above. Referring to FIG. 4, the time delay circuit TD is digital and comprises the arrangement of electronic components shown within the dashed line B. When the movable wiper W of the ignition switch is turned from the OFF position 1 to the PREHEAT position 2 and the current flows from the battery into the start input I1 of the time delay circuit TD (FIG. 1), the current flows from the start input terminal I1 (FIG. 4) through a diode D1 (type 1N4002) which prevents damage to the apparatus if the battery B polarity is reversed. The current flowing through the diode D1 causes the full battery voltage to be applied to three segments of the time delay circuit TD: a voltage regulator VR, an oscillator circuit, and means for applying the battery voltage to the power and control relays RY1 and RY2 through the power and control outputs A1 and A2. The voltage regulator VR, which can be any of the conventional voltage regulating circuits well known in the art, provides a substantially constant potential $V_R$ of 5 volts to all points of the apparatus labeled $V_R$.

The oscillator circuit comprises an oscillator IC1 which may be type 1455 marketed by Motorola and RCA, a capacitor C1 (0.47 microfarad) and resistors R1 (18K ohms) and R2 (10K ohms). The current flowing from the diode D1 also flows through the resistor R1 to an input terminal 7 of the oscillator IC1 and to the resistor R2, the other end of which is connected to the input terminals 2 and 6 of the oscillator IC1 and the capacitor C1. The other end of the capacitor C1 and the terminal 1 of the oscillator IC1 are grounded. The circuit provides a time-varying output signal comprising a series of pulses at terminal 3. The period of each cycle approximately equals [R1+2(R2)]C1 seconds depending on the battery voltage and has a duty cycle equal to the resistance R2 divided by the sum of resistances R1 and 2(R2). The frequency of the output signal is voltage dependent, i.e., if the battery voltage decreases, the frequency of the oscillator IC1 decreases, and if the battery voltages increases, the frequency of the oscillator IC1 increases.

The circuitry for applying the battery voltage to the power and control relays RY1 and RY2 comprises a first and second storage register IC2A and IC2B which may be first and second flip-flops of type 4027 marketed by Motorola and RCA; transistors Q1 and Q2 (both type 2N4401); D2, D3 and D4 (all type 1N458A); a capacitor C2 (0.1 microfarad); and, resistors R3 (47K ohms), R4 and R5 (both 4.7K ohms). The current flowing from the diode D1 also flows through the diode D2 and the capacitor C2, providing a positive pulse to set inputs at terminals 7 and 9 of the first and second storage registers IC2A and IC2B, respectively, and enabling the resistor R3 to bias the set inputs low between pulses. This signal causes an output signal at terminals 1 and 15 of the first and second storage registers IC2A and IC2B to go high.

These output signals forward-bias the diodes D3 and D4, respectively, causing current flow through the corresponding resistors R4 and R5 into the base of each transistor Q1 and Q2, respectively. The current flow results in a corresponding collector current flow from the diode D1 through the power and control outputs A1 and A2 of the time delay circuit TD to the corresponding power and control relays RY1 and RY2 (FIG. 1). Energizing the relays RY1 and RY2 activates the power switch S1 and the 2-pole transfer switch S2, respectively, to energize the parallel combination of the filaments F1 and F2 with the battery B as described hereinabove.

The filaments F1 and F2 are then switched from this energized parallel combination back to an energized series combination to prevent them from overheating and burning out, as also described above. This is accomplished at the expiration of the preheat time period by control means (FIG. 4) comprising the oscillator circuit, a counter IC3 which may be type 4040 marketed by Motorola and RCA, a diode D5 (type 1N458A), a capacitor C3 (0.1 microfarad), and a resistor R6 (47K ohms). Pulses from the output at the terminal 3 of the oscillator IC1 are applied to a clock terminal 10 of the counter IC3. An output signal at the terminal 12 of the counter IC3 goes high after the counter IC3 tallies a predetermined number of pulses generated by the oscillator IC1 over a period of approximately seven seconds which has been defined as the preheat time period. The high signal from the terminal 12 of the counter IC3 forward-biases the diode D5 to reset the second storage register IC2B at the terminal 12. The capacitor C3 initializes the second storage register IC2B and the resistor R6 holds the reset low between signals. The other end of the resistor R6 and the terminal 8 of the second storage register IC2B are grounded. The high signal from the terminal 12 causes the output signal at the terminal 15 of the second storage register IC2B to go low, turning off the collector current of the transistor Q2 through the control output A2 to de-energize the control relay RY2 and the lamp L.

Although the preheat time period is, as stated, approximately seven seconds, it varies in an inverse relation with the voltage of the battery B. As discussed above, the frequency of the oscillator IC1 is proportionally dependent upon the voltage delivered by the battery B. Therefore, when the voltage decreases, the oscillator IC1 generates pulses at a slower rate. As a result, a longer period of time elapses before the counter IC3 tallies the predetermined number of pulses. Hence, a decreased battery voltage is applied to the filaments F1 and F2 for an increased preheat time period to achieve the same high operating temperature that would have been achieved had the battery voltage not decreased. The preheat time period varies in a similar inverse relation to an increased battery voltage.

When the preheat period expires, the lamp L is de-energized to apprise the operator that the engine is ready to start, as discussed above. To give the operator enough time to start the engine, the time delay circuit TD also comprises means to prevent the power relay RY1 from de-energizing for a prestart time period of approximately thirty seconds. This is accomplished by the oscillator circuit, the counter IC3, diodes D6 and D7 (both type 1N458A), a capacitor C4 (0.1 microfarad) and a resistor R7 (47K ohms). Pulses from the output at the terminal 3 of the oscillator IC1 are still being applied to the clock terminal 10 of the counter IC3. An output signal at the terminal 1 of the counter IC3 goes high after the counter IC3 tallies a predetermined number of pulses generated by the oscillator IC1 over a period of approximately thirty seconds which has been defined as the prestart time period. The high signal from the terminal 1 of the counter IC3 forward-biases the diode D6 to reset the first storage register IC2A at the terminal 4. The capacitor C4 initializes the first storage register IC2A and the grounded resistor R7 holds the reset low between signals. The high signal from the terminal 1 causes the output at the terminal 1 of the first storage register IC2A to go low which turns off the collector current flow of the transistor Q1 through the power output A1 to de-energize the power relay RY1. The output signal at the terminal 1 of the counter IC3 is also fed through the diode D7 to the capacitor C1 and the input terminals 2 and 6 of the oscillator IC1 which is disabled by the constant charge held on the capacitor C1 by the diode D7.

However, if the operator engages the starter ST (FIG. 1) by turning the movable wiper contact W of the ignition switch SW from the PREHEAT position 2 to the START position 3 before the prestart period expires, the current which is still flowing to the start terminal I1 of the time delay circuit TD will also flow to the reset input I2 of the time delay circuit TD, as discussed above. The current from the reset input I2 (FIG. 4) forward biases a diode D8 (type 1N458A) and resets the counter IC3 at the terminal 11. A capacitor C5 (0.01 microfarad) initializes the counter IC3, while resistor R8 (47K ohms) holds the reset low between signals. The other end of the resistor R8 and the terminal 8 of the counter IC3 are grounded. The high signal causes the counter IC3 to restart tallying the pulses generated by the oscillator IC1, thus causing the counter IC3 to tally another thirty-second period of pulses, as described above, before the power relay RY1 is de-energized. During this thirty-second, afterglow time period, the glow plugs continue to be heated while the engine is operating.

Whenever the movable wiper contact W (FIG. 1) of the ignition switch SW is turned back from the PRE-HEAT position 2 to the OFF position 1, the time delay circuit TD prevents the power and control relays RY1 and RY2 from energizing for a period of one to three minutes after the operator returns the movable wiper contact W of the ignition switch SW to the OFF position 1, as discussed above. To accomplish this, the time delay circuit TD (FIG. 4) also comprises a capacitor C6 (33 microfarads), which has been charged through the diode D2. When the wiper contact W is turned back to the OFF position 1, the capacitor C6 is discharged across the parallel resistor R9 (22M ohms). The values of the resistor R9 and the capacitor C6 set the time constant at a sufficiently low discharge rate with respect to the capacitor C2 to prevent a signal from being applied to the set inputs at terminals 7 and 9 of the first and second storage registers IC2A and IC2B for a period of one to three minutes.

The apparatus A (FIG. 1), as a singular module, applies power to two heater filaments of two glow plugs in the heads of cylinders in a diesel engine. Several modules, control relays RY2, or 2-pole transfer switches S2 can be connected in parallel, as required, for an engine having more than two cylinders. For example, three modules are connected in parallel for applying power to the heater filaments of six glow plugs in a diesel engine having six cylinders. The same number of modules is required for applying power to the heater filaments of five glow plugs. However, for an engine having an odd number of cylinders, one of the modules applies power to a heater filament of one glow plug and to a ballast load having substantially the same maximum rated voltage as the filament. The preferred embodiment of this module additionally comprises means to disconnect the ballast load during the preheat period because it functions primarily as a voltage divider during the prestart and the afterglow time periods.

It will be apparent that various changes may be made in details of connecting and programming the electronic components shown in the attached drawings and discussed in conjunction therewith without departing from the spirit and scope of this invention as defined in the appended claims. It will be appreciated that the functions accomplished by the time delay circuit TD can be effected by other types of devices such as mechanical, electromechanical, thermomechanical, or hydraulic devices. It will also be appreciated that the heater filaments can be energized by a vehicle battery, as specifically disclosed above, an inverter, or any other power source. It is, therefore, to be understood that this invention is not to be limited to the specific details shown and described.

What I claim is:

1. A circuit for use in preheating a diesel engine during starting, said engine having an associated power supply at a predetermined voltage, said circuit comprising first and second glow plugs each having a filament of a predetermined resistance and each having a maximum operating voltage less than such predetermined voltage, said filaments overheating to failure under continuous operation at such predetermined voltage, first switch means having a first position electrically connecting said first and second glow plug filaments in series and a second position electrically connecting said first and second glow plug filaments in parallel, second switch means which, when closed, applies power from the power supply through said first switch means to said filaments, and control means including means for closing said second switch means for a time period from the beginning of a preheat time prior to starting the diesel engine to the end of a predetermined afterglow time period after engine starting required for smooth engine idling and for minimizing engine noise and white smoke emission, means for maintaining said first switch means in said second position during such preheat time for a time period which varies as an inverse function of such predetermined power supply voltage and equals substantially the time required to raise the temperature of said filaments to a temperature sufficient for diesel engine starting and for subsequently changing said first switch means to said first position to reduce the voltage applied to each of said filaments during a prestart time period prior to engine starting and during such afterglow period, and means for opening said second switch means at the end of such afterglow period.

2. Apparatus as claimed in claim 1 and further including signal means for generating an alarm during such prestart period for notifying an engine operator that the diesel engine is ready for starting.

3. Apparatus as claimed in claim 1 or 2 which additionally includes means for preventing the application of the power supply voltage to said filaments and to said signal means for a predetermined period of time after said second switch means is opened.

* * * * *